US005467481A

United States Patent [19]

Srivastava

[11] Patent Number: 5,467,481

[45] Date of Patent: Nov. 21, 1995

[54] GLOVE WITH HAND-COLORING MATERIAL

[76] Inventor: Laxmi S. Srivastava, 1868 Loisview La., Cincinnati, Ohio 45230

[21] Appl. No.: 275,603

[22] Filed: Jul. 15, 1994

[51] Int. Cl.[6] ..... A41D 19/00

[52] U.S. Cl. ..... 2/161.7; 2/159; 2/161.6; 2/167; 2/168

[58] Field of Search ..... 2/158, 159, 161.6, 2/161.7, 167, 168, 169; 472/133; 132/319, 320, 73

[56] References Cited

U.S. PATENT DOCUMENTS

| | | | |
|---|---|---|---|
| 2,501,565 | 3/1950 | Halley | 2/167 |
| 2,621,333 | 12/1952 | Thomas et al. | 2/168 |
| 3,637,411 | 1/1972 | Agostinelli | 2/168 |
| 3,728,739 | 4/1973 | Semp | 2/168 |
| 3,852,826 | 12/1974 | Schindler | 2/168 |
| 4,022,211 | 5/1977 | Timmons et al. | 128/287 |
| 4,143,423 | 3/1979 | Sternlieb | 2/168 |
| 4,152,783 | 5/1979 | Choksi | 2/168 |
| 4,185,330 | 1/1980 | Stager | 2/167 |
| 4,540,407 | 9/1985 | Dunn | 2/168 |
| 4,668,224 | 5/1987 | Lentz et al. | 2/168 |
| 4,843,014 | 5/1989 | Cukier | 2/168 |
| 5,017,427 | 5/1991 | Machids et al. | 2/168 |
| 5,031,245 | 7/1991 | Milner | 2/167 |
| 5,173,966 | 12/1992 | DeLeo | 2/168 |

*Primary Examiner*—C. D. Crowder
*Assistant Examiner*—Amy B. Vanatta
*Attorney, Agent, or Firm*—Wood, Herron & Evans

[57] ABSTRACT

A user of gloves is automatically reminded to wash his hands, after taking off the gloves, by using a glove having an interior surface with a hand-coloring material that transfers onto the wearer's hand during use and remains on the hand after the glove is removed, in an amount sufficient that it is visible on the hand. The colorant is removable, as by washing.

14 Claims, 1 Drawing Sheet

GLOVE WITH HAND-COLORING MATERIAL

FIELD OF THE INVENTION

This invention relates to gloves and more particularly to gloves which provide a reminder to the wearer to wash the hands after using the gloves.

BACKGROUND OF THE INVENTION

The use of protective gloves by practitioners in medical, laboratory, dental, and toxic material work is standard practice. During surgery, for example, use of sterilized gloves helps protect the surgeon from contact with infectious agents carried by the patient, as well as lessening the chance of introducing infectious agents into the surgical opening. Unsterilized gloves are used in many examination procedures to protect the examiner from infectious or unsanitary agents carried by the patient. Laboratory technicians in a variety of fields, including medical diagnostics and testing, pharmacology, chemistry, and environmental, also use such gloves to protect themselves from contact with infectious, caustic, toxic, or otherwise harmful substances.

Protective gloves, including surgical, examination, and other types, and their methods of manufacture are well known. It is also well known that because of their close-fitting nature, some such gloves cannot easily be put on without the aid of a slip-increasing powder or other substance between the glove's interior surfaces and the wearer's hands. Typically, the slip-increasing substance is a powder and is applied to the interior surfaces of the gloves by the glove manufacturer. A number of slip-increasing powders are disclosed in the prior art. Examples may be seen in U.S. Pat. Nos. 2,621,333 (talc, sodium metaphosphate), 3,637,411 (cornstarch), 3,728,739 (polyglycolic acid), 4,143,423 (sodium bicarbonate), 4,540,407 (polyol powder), and 4,668,224 (oxidized cellulose).

In many procedures in which protective gloves are worn, health and safety considerations strictly dictate that the wearer should wash his or her hands after removing the gloves, because of the possibility that harmful agents may have come in contact with the hands through undetected openings in the gloves or the gloves' open ends. Experience shows, however, that despite the rules and despite the health risks both to the glove user and to others with whom he or she has later contact, some users do not always wash after removing their gloves, for a variety of reasons including forgetfulness. Existing means for reminding them to wash, such as posted signs, do not completely solve the problem. A more effective means for reminding users of gloves to wash after removing them is needed.

It has therefore been an object of this invention to provide an effective means for reminding a user of protective gloves to wash his or her hands after removing the gloves.

An effective reminder ideally would be one that the wearer of gloves is certain to see each and every time he or she used gloves and that cannot easily be ignored. A reminder message or symbol could be printed on the gloves themselves. While such a reminder might stand a better chance than a posted sign of being seen by the wearer, it could still be ignored without any immediate consequences. What is needed is a reminder that, if ignored by the wearer, will have immediate and undesirable consequences to him or her.

Further objects of this invention have therefore been to provide a reminder that results in a wearer of gloves being virtually certain to see a reminder to wash his or her hands after removing the gloves, and to provide a reminder that immediately and adversely affects the wearer who ignores it.

An effective reminder should also be one that does not require the wearer or a third party to take extra steps to put into effect. A disadvantage of posted signs, for instance, is that someone must remember and take the time to make and post them and ensure that they stay posted. A better reminder would automatically occur every time gloves are used, without the user or anyone associated with the user having to do anything extra.

Another object of this invention has therefore been to provide a means for automatically reminding a wearer of protective gloves to wash his or her hands after removing the gloves, without the need for any steps other than wearing the gloves.

SUMMARY OF THE INVENTION

The present invention improves on known protective gloves by applying a transferable hand-coloring material to the interior surface of the glove. The hand-coloring material may be applied to the glove by itself, or it may be mixed with a conventional slip-increasing powder before the latter is applied to the interior surface. The hand-coloring material is such that its presence does not impair the slip-increasing property of the conventional powder, if present. During use, when the interior surface is in contact with the wearer's hand, the hand-coloring material transfers from the interior surface onto the hand in an amount sufficient that it is, or is automatically activated to become, easily visible on the hand when the glove is removed. The nontoxic hand-coloring material may then be removed by washing the hand. A means is thus provided for automatically reminding the user to wash his or her hands after using the glove.

Because it tends to stay on the hand until washed off, the hand-coloring material is virtually certain to be seen by the user and cannot easily be ignored. The hand-coloring material may furthermore alert others that a person with the color on his hands has not yet washed. Thus, a user who ignores the reminder and does not wash is adversely affected in two ways. First, he has unsightly colored hands. Second, he is labeled as a potential health risk to himself or others familiar with the significance of colored hands.

Another advantage of this invention is that it reduces the likelihood that a user of protective gloves will develop folliculitis (a skin disorder characterized by inflammation of the pores) as a result of frequent glove use. Some people who frequently use gloves dusted with slip-increasing powders develop folliculitis where the powdered interior surfaces contact their hands. Folliculitis is thought in such cases to be caused by the powder blocking the pores in the skin. Failure to wash the hands after using gloves prolongs the exposure to the powder which tends to cling to the skin. With the present invention, the user is reminded to wash his hands after removing the gloves. Washing is an effective means of removing the otherwise nearly unnoticeable slip-increasing powder from the hands. The period of exposure to the powder, and therefore the likelihood of developing folliculitis, are thereby reduced.

Yet another advantage of the invention is that, should any colored powder shed from the glove, for example during use in surgery, the laboratory, or the chemical industry, where the particles could cause contamination, their coloration makes the shedding apparent and appropriate precautions can be taken or correction made.

Because the hand-coloring material may have prolonged contact with the skin during glove use, preferable hand-coloring materials are those colorants that are already approved by the Food and Drug Administration for use in cosmetics. A number of such colorants are known. Among the organic colorants approved for cosmetic uses are alkanet (red), annatto (orange), carotene (orange), chlorophyll (green), cochineal, henna (brown), and saffron (yellow). Approved inorganic colorants include iron oxides such as ochre, umber, and sienna (yellows to reddish browns), chromium oxide (green), ultramarine (blue), carbon black, and coal tar colorants. Those FDA-approved colorants designated by "FD&C" or "D&C" are also suitable. The inorganic colorants are for the most part insoluble in water; the organic colorants may be soluble or insoluble depending on the particular colorant.

The hand-coloring material should have, or be capable of providing, a color that is easily visible on the skin. Because the skin pigmentation of potential users of this invention may vary widely, and because it is desirable for ease of manufacture and use to employ the same color for all gloves, the color of the material must be such that it is easily visible on all skin types. Blues and greens are preferred because they contrast well with all types of skin pigments. The colorants commonly used to impart a blue or green color to cosmetics such as eye shadows are preferred colorants because they are well tolerated on sensitive skin such as the upper eyelid, and therefore pose minimal risk of adverse reaction on the skin of the hands. Such colorants include ultramarine, which imparts a blue color, and chromium oxide, which imparts a green color.

Both ultramarine and chromium oxide may be produced in powdered form suitable for use as hand-coloring materials. Because they both are insoluble in water, the primary means of transfer from the glove's interior surface onto the hand is by contact and incidental friction that occurs as the glove is donned and used. However, this invention is not limited to any particular process for transferring the hand-coloring material from the glove's interior surface onto the hand. The transfer may result from contact and incidental friction between the hand and loosely adherent powder on the glove's interior surface. Alternatively, the hand-coloring material may be water soluble and may be dissolved when it contacts perspiration on a wearer's hand, thereby staining the hand. The hand-coloring material may have color when applied to the glove, or it may be such that it displays little or no color until activated or wetted by moisture such as perspiration. These transfer processes may occur alone or in combination. The particular process or processes responsible for transferring the hand-coloring material depend largely on the properties of the material used. For example, water-soluble substances will tend to be dissolved by perspiration on the wearer's skin, whereas water-insoluble substances will not. The latter will therefore depend more on simple contact or friction for transfer than will the former. With either class of materials, some transfer by friction may occur during the donning and subsequent use of the gloves.

In a preferred embodiment of this invention, ultramarine in powdered form is mixed with a conventional slip-increasing powder consisting of talc and cornstarch until the mixture is substantially homogeneous. The ultramarine may have particle sizes from about 1 micron to 150 microns. It is desirable that the powdered ultramarine be able to pass through a 100 mesh screen, as designated in the U.S. Sieve Series; preferably, the ultramarine should be able to pass through a 200 mesh screen, which assures that there are no particles larger than about 74 microns. Techniques for mixing are well known. For instance, the talc, cornstarch, and ultramarine may be placed into a spiral or ribbon mixer and thoroughly blended. The mixture may then be screened one or more times through a suitably selected screen to remove particles larger than a certain size. Too large a particle size may impair the slip-increasing property of the mixture and may also give a grainy feel to the glove wearer. A 100 mesh screen is suitable for screening the mixture, with a 200 mesh screen being preferred.

The resulting mixture is then applied to the interior surface of a glove by any suitable technique that assures a substantially uniform surface coating. Such techniques are disclosed, for example, in U.S. Pat. Nos. 3,728,739 and 4,668,224.

Although ultramarine is discussed as a preferred hand-coloring material, it is to be understood that this invention is not limited to the specific embodiments described herein. Likewise, talc and cornstarch are discussed as slip-increasing powders for illustrative purposes only, and it is to be understood that this invention may be practiced with any suitable slip-increasing powder, bulking agent, filler, extender, carrier, or other substance.

DETAILED DESCRIPTION

The present invention may be practiced with a variety of glove types designed for a variety of uses. Potential applications include, but are not limited to, the following examples.

Example 1

Medical-type glove

Figure 1:
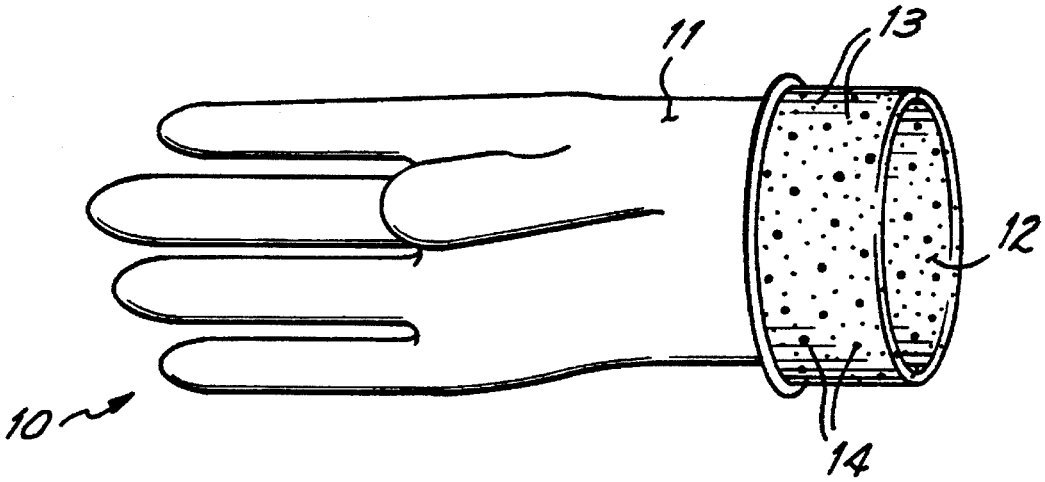
FIG. 1 shows a surgical glove with the wrist portion partially upturned to expose a portion of the interior surface. The interior surface is schematically shown to be coated, in accordance with a preferred embodiment of the invention, with a mixture comprising a hand-coloring material and a slip-increasing powder.

Medical, dental, and laboratory gloves, of the type conventionally made of latex or synthetic rubber, are particularly advantageous applications of the present invention. Referring to FIG. 1, there is shown a glove 10 having an exterior surface 11 and an interior surface 12, the interior surface being the surface that contacts a wearer's hand during use of the glove. According to a preferred embodiment of the invention, after the glove has been manufactured, the interior surface is coated with a mixture of a slip-increasing powder 13 and a hand-coloring material 4. By way of illustration, the slip-increasing powder may consist of talc mixed with cornstarch in suitable proportions. For example, an approximately four-to-one ratio of talc to cornstarch gives good slip-increasing properties.

Figure 2:
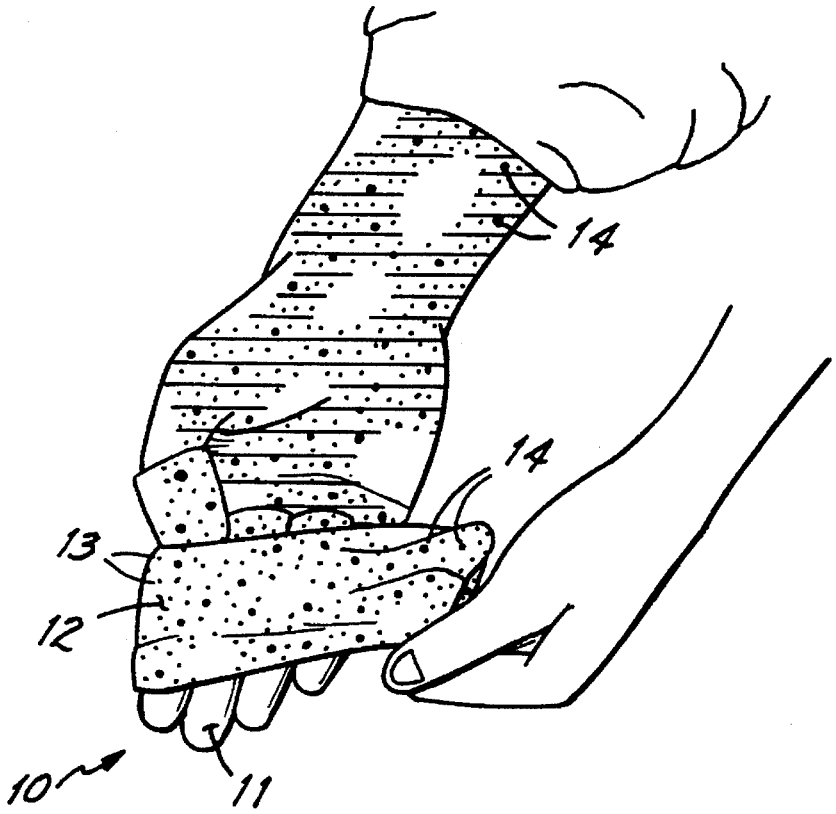
FIG. 2 shows a wearer removing the glove after use. Some of the hand-coloring material is schematically shown to have transferred from the glove's interior surface onto the wearer's hand.

The talc-cornstarch mixture and hand-coloring material are mixed in proportions selected to insure that when a wearer removes the glove after use, the hand-coloring material that has transferred from the interior surface onto the hand is easily visible, as shown in FIG. 2. The proportions may vary depending on the hand-coloring material used. The mixture may contain from about 1 percent to 20 percent of hand-coloring material by weight, more preferably from about 2 percent to 10 percent by weight, and most preferably about 6 percent by weight. In general, it is desirable to use the smallest effective amount.

Ultramarine is selected as the preferred hand-coloring material in the present embodiment. One example of a formula for such a mixture, to be applied to the glove's interior surface, is as follows:

| Formula No. 1 | |
|---|---|
| Talc | 75.2% by wt. |
| Cornstarch | 18.8% |
| Ultramarine | 6.0% |

Particle sizes of the ingredients may for example range from about 1 micron to 150 microns. Preferably, all ingredients should be able to pass through a 200 mesh screen, which assures that no particles larger than about 74 microns are present. If necessary, the ingredients may be ball milled or otherwise processed to enable them to pass through the screen.

The ingredients may then be placed into a spiral mixer or other suitable device and mixed until thoroughly blended, after which the mixture may be screened through a 200 mesh screen to remove any agglomerations. The resulting mixture may then be applied to the interior surface of the glove by any suitable technique. For instance, the powder may be blown into the glove. Alternatively, the glove may be turned inside out, placed in a tumbler with a quantity of the mixture, and tumbled until the wearer-contacting surface is well coated with the mixture. The glove may then be shaken to remove excess loose mixture and turned right side out.

Other hand-coloring materials and formulations may be used. For instance, one or more of the FD&C or D&C certified colorants may be used to produce a suitable color shade, and then may be mixed with a slip-increasing powder. The proportion of such colorants used depends on the pure dye content of the colorants, which can vary from about 2 percent to 80 percent. A representative formula is as follows:

| Formula No. 2 | |
|---|---|
| Cornstarch | 96% by wt. |
| D&C colorant(s) | 4% |

The proportion of colorant may be varied if necessary to provide an easily visible color on the hands after glove use.

Example 2

Gloves For Pharmaceutical and Chemical Use

The present invention may also be applied to protective gloves used in the pharmaceutical and chemical industries or wherever toxic, caustic, acidic, or other dangerous drugs or chemicals are encountered. Such gloves typically are made of rubber or plastic, and often have a slip-increasing powder. Following is an example of a formula for such use:

| Formula No. 3 | |
|---|---|
| Cornstarch | 98% by wt. |
| D&C colorant(s) | 2% |

Example 3

Gardening and Household Gloves

Soil contains microorganisms that can be harmful to humans if ingested. Pregnant women especially should avoid contact with soil because harm to the fetus can result. Gardening gloves help protect against contact with soil when working in the yard or garden, but often some soil comes in contact with the hands even when gloves are used, sometimes in small amounts that may not be easily visible. If not washed off, there is a danger that some soil may be accidentally ingested through hand-mouth contact. The present invention may advantageously be applied to gardening gloves to remind the gardener to wash his or her hands after removing the gloves.

Because gardening gloves tend to be all cloth, suitable coloring materials are powders, with or without a powdered carrier, or liquids mixed with a powdered carrier. The formulations given in Example 1 may suitably be used in such gloves. The optimal percentage of coloring material may be determined by a series of simple tests at differing proportions to assure good visibility of the color on the hands after the gloves are removed.

This invention can also be used in household gloves which are used for purposes such as furniture refinishing, cleaning or painting. Such gloves typically do not require a slip-increasing powder to facilitate donning.

The hand-coloring material may be applied to the interior surface either by itself or mixed with a carrier or bulking agent. Some coloring materials may be suitable for use without a carrier. Some coloring materials, however, may not be practical for undiluted use, because either the color may be too intense or the form of the material may be unsuitable. When the coloring material is an aqueous liquid and the glove has a cloth lining, for example, a powdered carrier may be needed to prevent the lining from absorbing the material when it is applied. It may also be desirable to use a relatively inexpensive bulking agent to make more economical use of the coloring material.

For lined or unlined household and shop gloves, the formulations given in Example 1 may be applied to the interior surface, where the talc and/or cornstarch mixture here acts not as a slip-increaser but as a carrier or bulking agent for the colorant. Because of the loose-fitting nature of the gloves, which may make it more difficult for the transfer of color onto the hand to take place, the percentage of colorant may be increased if necessary to insure good visibility on the hand. A tack-enhancing material, for example wax, petrolatum, or glyceryl monostearate, may be included to ensure that the powder sticks lightly to the hands.

Alternatively, a fluid or semi-fluid, oil-based carrier may be mixed with a coloring material suitable for coloring oils, such as alkanet. The oil-based carrier will not evaporate during storage of the gloves before use, and may facilitate transfer of the coloring material onto the user's hands.

The foregoing examples are merely illustrative applications of the present invention. Other applications, hand-coloring materials, slip-increasing powders, or carriers may be used without departing from the spirit and scope of the claims that follow.

What is claimed is:

1. A glove having an interior surface which in use contacts a wearer's hand, said interior surface having on it a nontoxic hand-coloring material that will transfer from said interior surface onto the wearer's hand during use, said hand-coloring material remaining on the hand, when the glove is removed, in an amount sufficient that said hand-coloring material is easily visible on the hand, said hand-coloring material being one which is removable from the hand by washing.

2. The glove of claim 1, wherein said hand-coloring material is a powdered or liquid colorant and is blended with a powdered carrier.

3. The glove of claim 2 wherein said colorant is about 1–20% by weight of the total weight of said material and said carrier.

4. The glove of claim 1, wherein said hand-coloring material is a powder having particle sizes in the range of about 1 micron to 150 microns.

5. The glove of claim 1, wherein said hand-coloring material is an inorganic pigment.

6. The glove of claim 1, wherein said hand-coloring material is blue or green in color.

7. The glove of claim 1, wherein said hand-coloring material is a liquid colorant.

8. A glove having an interior surface which in use contacts a wearer's hand, said interior surface being coated with a nontoxic mixture comprising a slip-increasing powder and a hand-coloring material that will transfer from said interior surface onto the wearer's hand during use, said hand-coloring material then remaining on the hand, when the glove is removed, in an amount sufficient that said hand-coloring material is easily visible on the hand, said hand-coloring material being one which is removable from the hand by washing.

9. The glove of claim 8, wherein said slip-increasing powder comprises at least one of talc and cornstarch.

10. The glove of claim 9, wherein said hand-coloring material comprises ultramarine.

11. A method for automatically reminding a wearer of a glove to wash his hands after removing the glove, comprising providing a hand-coloring material having a color which renders it visible on a hand and which is removable by washing the hand, applying said hand-coloring material to an interior surface of a glove which in use contacts a wearer's hand, wearing the glove for use, some of said hand-coloring material transferring from said interior surface on the wearer's hand in use, and removing the glove from the hand after use, some hand-coloring material remaining on the wearer's hand when the glove is removed, in an amount sufficient that said hand-coloring material is visible on the hand.

12. The method of claim 11 wherein said material is a powder and is loosely adhered to said interior surface.

13. A method for automatically reminding a wearer of a glove to wash his hands after removing the glove, comprising, coating an interior surface of a glove with a hand-coloring material and a slip-increasing powder, wearing the glove and thereby transferring some of said hand-coloring material from said interior surface to the wearer's hand, and removing the glove from the hand, some hand-coloring material remaining on the wearer's hand when the glove is removed, in an amount sufficient that said hand-coloring material is visible on the hand.

14. The method of claim 13 wherein said coating step is carried out by blowing a particulate mixture of said hand-coloring material and said slip-enhancing powder into said glove.

* * * * *